US005576509A

United States Patent [19]

Refouvelet et al.

[11] Patent Number: 5,576,509

[45] Date of Patent: Nov. 19, 1996

[54] PYROTECHNIC DETONATOR AND METHOD FOR MANUFACTURING SAME

[75] Inventors: Joseph Refouvelet, Tarbes; Hervé Lebreton, La Loubere; Jean-Claude Bernardy, Aureilhan; Yves Castel, Tarbes, all of France

[73] Assignee: Giat Industries, Versailles, France

[21] Appl. No.: 368,307

[22] Filed: Jan. 4, 1995

[30] Foreign Application Priority Data

May 31, 1994 [FR] France ..... 94 06605

[51] Int. Cl.[6] ..... F42B 3/10; F42C 19/12

[52] U.S. Cl. ..... 102/202.7; 102/202.8; 102/202.9; 102/202.14

[58] Field of Search ..... 102/202.5, 202.7, 102/202.8, 202.9, 202.14; 280/737

[56] References Cited

U.S. PATENT DOCUMENTS

| | | | |
|---|---|---|---|
| 2,767,655 | 10/1956 | Seavey . | |
| 2,968,985 | 1/1961 | Seavey . | |
| 3,256,056 | 6/1966 | Armstrong | 102/202.14 |
| 3,831,523 | 8/1974 | Thomas et al. | 102/202.14 |
| 3,971,320 | 7/1976 | Lee | 102/202.14 |
| 4,208,967 | 6/1980 | Betts | 102/202.14 |
| 4,819,560 | 4/1989 | Patz et al. . | |
| 5,029,529 | 7/1991 | Mandigo et al. | 102/202.9 |
| 5,241,910 | 9/1993 | Cunningham et al. | 102/202.9 |
| 5,423,261 | 6/1995 | Bernardy et al. | 102/202.14 |
| 5,433,147 | 7/1995 | Brede et al. | 102/202.9 |
| 5,454,320 | 10/1995 | Hilden et al. | 102/202.7 |

*Primary Examiner*—Michael J. Carone
*Assistant Examiner*—Theresa M. Wesson
*Attorney, Agent, or Firm*—Oliff & Berridge

[57] ABSTRACT

A detonator includes a casing having a metal wall attached to a metal endplate, the endplate being penetrated by at least two electrodes. At least one electrode is electrically insulated from the endplate by an insulating material. The casing includes a molded plastics material surrounding at least the endplate and a portion of the electrodes.

15 Claims, 3 Drawing Sheets

PYROTECHNIC DETONATOR AND METHOD FOR MANUFACTURING SAME

BACKGROUND OF THE INVENTION

The field of the present invention is that of pyrotechnic detonators, i.e., components capable of transmitting a pyrotechnic effect in a pyrotechnic circuit.

Detonators are known from U.S. Pat. Nos. 2,968,985, 2,767,655 and 4,819,560, the casing, of which are made of plastics material. These inexpensive detonators are intended particularly for detonating explosive cartridges used in mining and quarrying. They usually have a casing in plastics material of uniform thickness that encloses the detonating charge and is fragmented when the charge is detonated.

Although these detonators are inexpensive, their level of safety and reliability is such that they cannot be used in technical areas other than in mining, for example in the field of weapons or that of safety systems for motor vehicles.

Moreover such detonators are not protected against electrostatic discharges.

SUMMARY OF THE INVENTION

One object of the invention is to propose a detonator that does not have such disadvantages.

The invention has a first aim to propose a detonator that is extremely reliable and robust while at the same time being highly resistant to electrostatic discharges.

Another purpose of the invention is to propose a detonator capable of being produced in large numbers at less cost and in a safe manner, which permits its use for example, for detonating safety devices used in vehicles, particularly motor vehicles.

Finally the invention proposes a detonator with a very high level of safety, capable of detonating primary explosives, but also enabling the use of pyrotechnic compositions of low sensitivity.

One aspect of the present invention is a pyrotechnic detonator comprising a pyrotechnic substance placed inside a casing. The casing includes a metal wall attached to an endplate also made of metal, the endplate being penetrated by at least two electrodes of which at least one is electrically insulated from the endplate by an insulating material. The casing comprises a molding in plastics material surrounding at least the endplate and part of the electrodes.

According to a first embodiment, the casing may be closed by a pad over which the edge of the metal wall is folded.

A seal may be placed between the pad and the edge of the wall.

According to a second embodiment, the molding may also surround the metal wall and support a plug in plastics material that closes the casing.

On the endplate may also be mounted a pellet including an insulating substrate on which will be placed a semiconductor bridge partially covered by two conducting studs.

According to another embodiment, one of the conducting studs may be connected to the metal endplate of the casing using a semiconductor well passing through the substrate, the endplate being itself connected to one of the electrodes.

In a variant of the invention, a layer of thermally and electrically insulating material may be deposited on the semiconductor bridge and insulates the bridge from the pyrotechnic substance.

The insulating material may be silicon oxide or nitride deposited in a thin film of between 0.5 and 10 micrometres in thickness.

The pyrotechnic substance may be advantageously deposited in the casing using a wet charging process.

The mean grain size of the ingredients of the pyrotechnic substance may be chosen to be of the same order of magnitude as the dimensions of the semiconductor bridge.

BRIEF DESCRIPTION OF THE DRAWINGS

Other advantages of the invention will become clear from the description of the different methods of construction, with reference to the attached drawings in which.

DETAILED DESCRIPTION OF PREFERRED EMBODIMENTS

Figure 1:
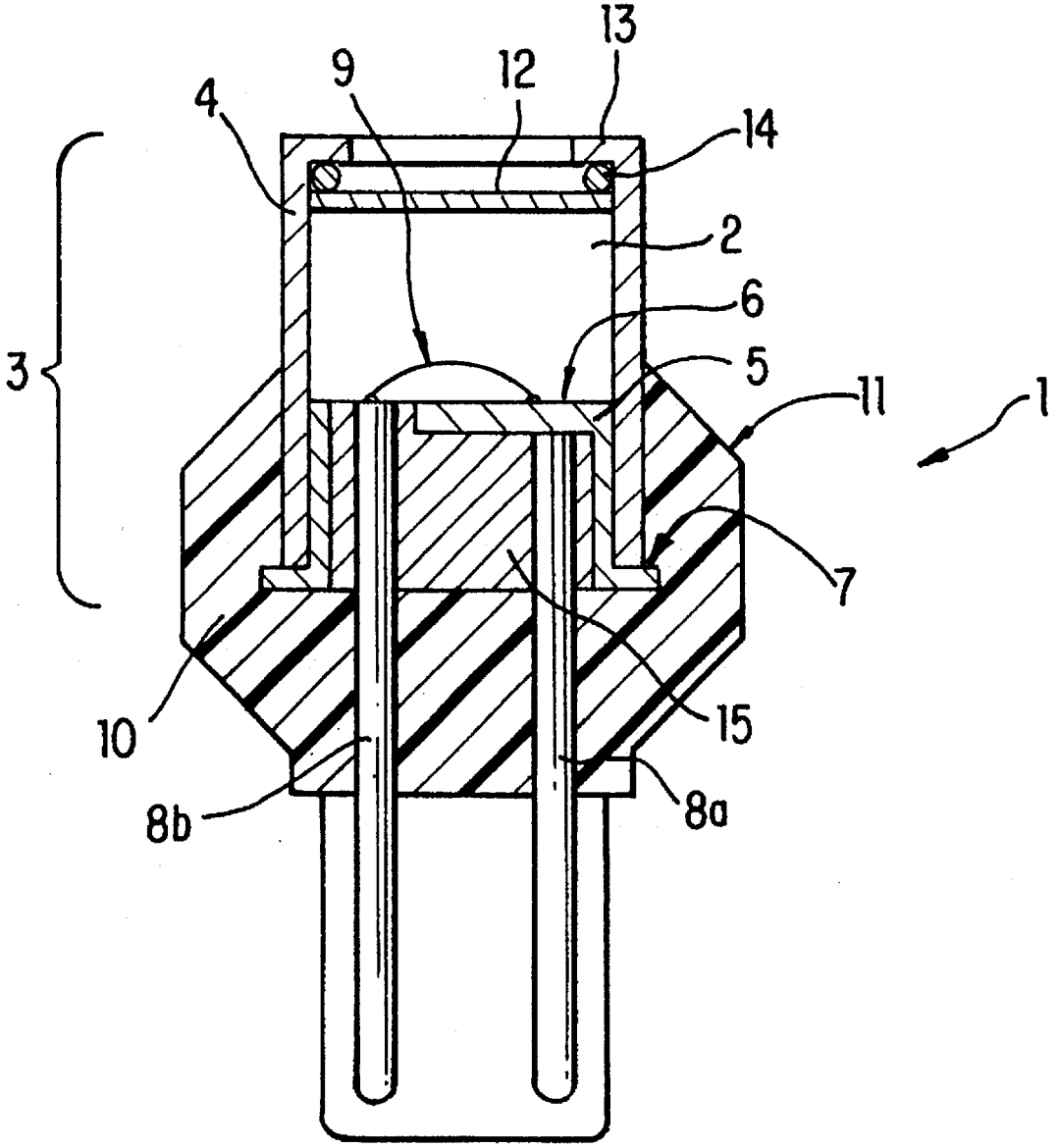
FIG. 1 is a longitudinal section of a detonator according to a first embodiment of the invention.

Referring to FIG. 1, a detonator 1 according to the invention comprises a pyrotechnic substance 2 of known type (for example an explosive [detonator] or an igniting pyrotechnic composition), placed in a casing 3.

The casing 3 comprises a cylindrical metal wall 4 attached to an endplate 5 that is also made of metal.

Both wall 4 and endplate 5 are made of stainless steel.

The endplate 5 here is in the shape of a cup and its top surface 6 is contiguous with the pyrotechnic substance 2 and has a wide rim or flange 7 against which the wall 4 is pressed.

The endplate and the wall are joined together by electric welding, laser welding or another type of welding.

The endplate 5 is penetrated by two electrodes 8*a*, 8*b* of which one (8*a*) is in electrical contact with the endplate 5 and the other (8*b*) is electrically insulated from the endplate by an insulating material 15 such as a glass filling.

A structure for triggering the pyrotechnic substance is mounted between the electrodes. In this case, the triggering structure includes a resistive wire or filament 9 that connects the electrodes 8*a* and 8*b* together and is attached by being soldered to their ends.

The electrical characteristics of the wire 9 are determined in a conventional manner by the skilled operator according to the pyrotechnic characteristics of the substance 2. For example, a wire resistance of 2 ohms may be adopted for a substance of the quaternary type (a four-component substance, for example the known combination of potassium perchlorate, lead thyocyanate, antimony sulphide and lead tricinate).

Finally plastics material 10 is molded on the casing 3, surrounding the endplate 5 and part of the electrodes 8*a*, 8*b*. The integrity of the assembly is improved by the presence of the flange 7.

This molding improves the mechanical strength of the component particularly with regard to impact. It also enhances the electrical insulation of the electrodes and protects the glass filler 15.

The molding 10 is a plastics material of the polyamide or polycarbonate type, a material that may be reinforced with glass fibres to increase its mechanical strength.

For example, a reinforcement of 10% to 40% by weight of short glass fibres (a few tenths of a millimetre long) can be adopted.

The molding 10 has a bulge 11 providing a bearing surface that makes it possible, for example, to place it in a cavity made in a pyrotechnic substance or in a detonation device not shown i.e., a cavity with the same diameter as the casing).

The wall 4 of the casing is closed by a pad 12 over which the edge 13 of the metal wall is folded.

An O-ring seal 14 is interposed between the pad 12 and the rim 13 of the wall.

The pyrotechnic substance 2 is placed inside the casing 3, preferably using a wet charging process, but it could also be introduced by compression.

Clearly, therefore the detonator according to the invention can be manufactured easily and at less cost, the process requiring few operations, each of which being simple and easily automated.

The endplate carrying the electrodes and the insulating material constitutes a sub-assembly that is produced in a standard manner in large numbers in the electronics industry for the manufacture of components such as transistors or thyristors. Such a component is extremely inexpensive.

The plastic molding also makes it possible to obtain the shape enabling the component to be fitted into the desired application. Such a molding is inexpensive.

The filament is soldered on the electrodes using soldering techniques adapted to the wiring of integrated circuits, these techniques being inexpensive and allowing speedy production.

The substance is preferably introduced directly into the cavity of the casing and on the filament by compression.

The metal wall and endplate also give the detonator excellent mechanical rigidity and, by forming a Faraday cage, give the detonator substantial ability to withstand electrostatic discharges while protecting it from currents induced by the electromagnetic environment.

As a variant it would be possible to replace the resistive wire 9 by a plaque, for example, a semiconductor, a printed circuit or an integrated circuit that could itself be bonded to the endplate 5.

The pyrotechnic substance 2 is preferably introduced using the known wet loading process.

The substance is, for example, a quaternary substance of a known type and combining the following in conventional proportions not stated here but well known to the skilled operator:

a primary explosive (such as lead tricinate);

an oxidizing agent (such as potassium perchlorate, potassium chlorate or potassium nitrate);

a reducing agent (such as antimony sulphide, calcium silicide, graphite or powdered aluminium); and an additive intended to enhance or reduce the power of the detonator (such as lead thyocyanate, aluminium powder or lead dioxide).

This substance will be mixed with 1 to 5% by weight of a binder such as natural gum or a synthetic binder and with water (5 to 30% by weight).

The advantage of using a wet mixture is that it is then possible to work on the mixture and to divide the substance and hence reduce the risk of accidental detonation.

The substance is thus formed into pellets of the same diameter as the casing using appropriate tools. This pellet can be compressed by a punch at moderate pressure (20 to 40 megapascals) allowing the pyrotechnic substance to completely fill the casing 3 and to be in intimate contact with the filament 9.

Compression also has the result of driving the water to the top of the substance. The filled detonators are then passed through a hot tunnel (50° to 80° C.) to evaporate the water. Drying the substance has the effect of restoring its sensitivity.

Figure 2:
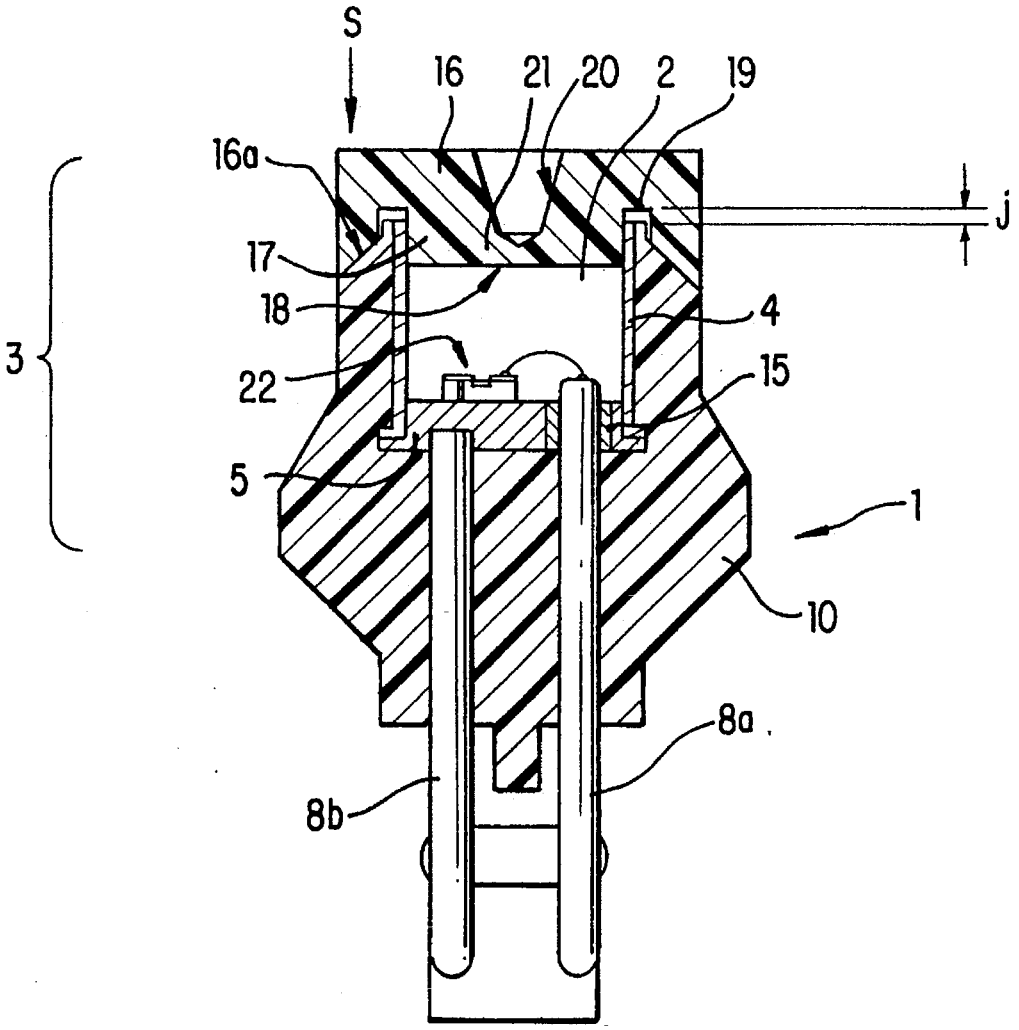
FIG. 2 is a longitudinal section of a detonator according to a second embodiment of the invention.

FIG. 2 shows another embodiment of the invention in which the endplate 5 is in the shape of a plate with a peripheral rim 7 on which the metal wall 4 is fitted.

Both wall and endplate are again made of stainless steel and welded by electric arc.

The electrode **8*b* is soldered into a blind hole in the endplate 5 while the electrode 8*a* passes through the endplate. The electrode 8*a* is electrically insulated from the endplate by a glass ring 15**.

In this embodiment, the molded plastics material 10 surrounds the endplate, part of the electrodes and also the metal wall 4 substantially over its entire height. The assembly is made more rigid by the presence of the rim 7.

The casing 3 is closed by a plug 16 made of the same plastics material as the molding 10.

The plug 16 has a central cylindrical part 17, of the same diameter as the metal wall 4, whose forward surface 18 bears upon the pyrotechnic substance 2.

The periphery of the plug 16 has a tapered profile **16*a* that comes into contact with a matching profile made on the molding 10. The tapered profile 16*a* is separated from the central part 17 by an annular groove 19**.

When the plug is fitted to the component filled with pyrotechnic substance, there is a clearance j of the order of one tenth of a millimeter between the bottom of the groove 19 in the plug and the top of the molding 10 (the clearance is exaggerated in the figure).

The clearance permits slight compression of the pyrotechnic substance during the assembly process for example by ultrasonic welding.

Such an arrangement makes it possible first to avoid any empty space inside the casing that limits any risk of friction and, secondly, ensures good contact between the pyrotechnic substance and the detonation device.

In this way the safety and reliability of the detonator are enhanced.

If the substance is charged using a wet process, the plug is welded in place after evaporation of the water as previously described.

Ultrasonic welding is performed in a known manner by applying a transducer of a welding unit on a circular ring of the flat outer surface of the plug, the ring being located substantially facing the tapered profile **16*a*** (marked S).

The vibrations of the transducer cause the surfaces in contact, i.e., the tapered surfaces, to weld together.

As a variant, it would be possible to attach the plug to the casing using adhesives or clips.

The plug 16 also has a blind hole 20, on its outer surface, which thus forms on the plug a zone of reduced thickness or bursting disc 21.

During the functioning of the detonator, the pressure generated by the pyrotechnic substance 2 bursts the zone of reduced thickness 21 and the detonator transmits a pyrotechnic effect in an axial direction.

The advantage of the method of construction of FIG. 2 is that it produces a completely sealed detonator.

The presence of the metal wall and endplate also give protection against electromagnetic interference and static electricity.

Figure 3:
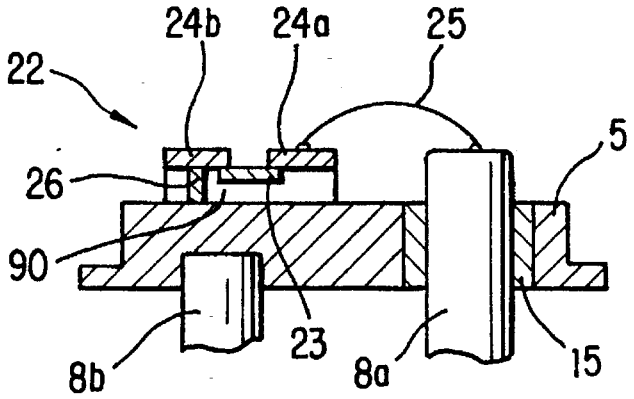
FIG. 3 is an enlarged view of the detonation system used in the second embodiment.
Figure 4:
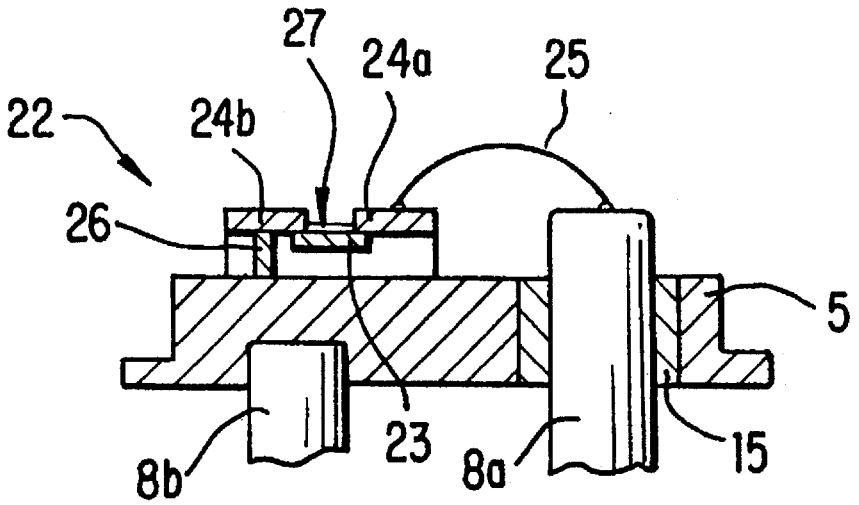
FIG. 4 is an enlarged view of the detonation system used in the second embodiment shown the insulative layer.

FIG. 3 is a partial enlarged view of the detonation device used in the second embodiment.

The detonation device includes a pellet 22 of an insulating substrate based upon non-doped silicon, on which is deposited a semiconductor bridge 23 (formed from doped silicon) and partly covered by two conducting studs 24*a* and 24*b* (formed of, for example, aluminium).

The distance between the studs is between 50 and 100 micrometers and preferably of the order of 80 micrometers. The characteristics of the detonator will be determined in a known manner by modifying the separation of the studs, and the dimensions and doping of the semiconductor bridge.

The stud 24*a* is connected to the electrode 8*a* by a connecting wire 25 soldered in position.

The stud 24*b* is connected to the electrode 8*b* through the metal endplate 5 via a semiconductor well 26 (doped silicon) that passes through the insulating substrate 90.

Such an arrangement makes it possible to reduce the risk of breaks in the connecting wires (one wire is used instead of two) during the operations of charging the pyrotechnic substance.

The technologies used for producing the pellet 22 are well known to the skilled operator in the field of manufacturing electronic semiconductor components (for example, doping silicon, vacuum metallization or soldering).

These techniques are adapted to produce components in large numbers and are therefore inexpensive.

The utilization of a means of detonation with a semiconductor bridge makes it possible to obtain a detonator whose thresholds of safety and operation are precise, which enhances its safety.

A pyrotechnic substance will be adopted whose mean grain size is the same order of magnitude as the dimensions of the semiconductor bridge. Such an arrangement makes it possible to limit heat transfer at low temperature while permitting heat transfer at high temperature by convection and/or projection which enhances the non-linear effect of the semiconductor (i.e., the precision of the operating threshold and hence safety).

For example, a composition with a mean grain size of 80 micrometers will be chosen (i.e., actual grain size between 10 and 200 micrometers) for a bridge that is 80 micrometers in width.

Such a detonation device also makes it possible to obtain a high concentration of energy on a zone of small area (the semiconductor bridge).

Hence this technology enables less sensitive pyrotechnic substances to be used, for example, compositions based upon boron (20% by weight) and potassium nitrate (80% by weight) or compositions involving aluminium (20% by weight) and copper oxide (80% by weight).

The pyrotechnic substance is preferably charged using a wet process as already described. This type of charging ensures reproducibility of the contact between the semiconductor bridge and the substance and also makes it possible to obtain precisely the desired mass of pyrotechnic substance.

As a variant, it is also possible to introduce a dry pyrotechnic substance into the casing.

The substance will then be compressed into the cavity of the casing at a higher pressure (for example of the order of 100 to 200 megapascals). As before, the plug 12 will be pressed against the pyrotechnic substance when it is attached by being welded to the skirt.

As a variant, it is also possible to deposit a layer of thermally and electrically insulating material 27 on the semiconductor bridge. This layer may, for example, be a film of silicon oxide or silicon nitride 0.5 to 10 micrometers in thickness.

Such an insulating film makes it possible to considerably reduce the heat transfer between the semiconductor bridge and the pyrotechnic substance. The substance cannot therefore be detonated or degraded when a low current (in the order of 0.3 amperes) passes. However at a high current (above 0.8 amperes) the insulating film is penetrated by silicon plasma sprays at high pressure and temperature and can detonate explosives or pyrotechnic substances of low sensitivity (for example a composition combining boron and potassium nitrate).

Such a variant makes it possible to obtain a detonator that is even safer.

It is also possible to use the technology of integrated circuits in order to form a pellet 22 comprising logic circuits that operate integrated switches (based upon transistors or thyristors) that can prevent the current from flowing in the semiconductor bridge 23. The detonator cannot be detonated except in response to a predetermined coded signal transmitted or superimposed on the power signal supplied by the electrodes (or transmitted by special additional electrodes passing through the endplate 5).

We claim:

1. A pyrotechnic detonator comprising:

a pyrotechnic substance;

a casing for housing said pyrotechnic substance, said casing having a metal wall attached to a metal endplate, the metal endplate being penetrated by at least one of at least two electrodes disposed within the casing below the pyrotechnic substance, and at least one of said at least two electrodes being electrically insulated from the metal endplate by an insulating material; and a molded plastics material surrounding at least the metal endplate and a portion of the at least two electrodes.

2. The detonator according to claim 1, wherein the casing includes a pad disposed over the pyrotechnic substance so as to close the casing, and wherein an edge of the metal wall is folded and extends over the pad.

3. The detonator according to claim 2, further comprising a seal placed between the pad and the edge of the metal wall.

4. The detonator according to claim 1, wherein the molded plastics material also surrounds the metal wall and supports a plug made of plastics material, said plug being formed at an end of the metal casing opposite where the at least one of two terminals is disposed, said plug being adapted to close the casing.

5. The detonator according to claim 1, further comprising a pellet supported on the metal endplate, said pellet being mounted on an insulating substrate on which a semiconductor bridge is deposited, said semiconductor bridge being partially covered by two conducting studs.

6. The detonator according to claim 5, wherein one of the conducting studs is connected to the metal endplate of the casing via a semiconductor well that passes through the insulating substrate, the metal endplate being connected to one of the at least two electrodes.

7. The detonator according to claim 5, further comprising a layer of thermally and electrically insulating material deposited on the semiconductor bridge, said layer being adapted to insulate the semiconductor bridge from the pyrotechnic substance.

8. The detonator according to claim 7, wherein the thermally and electrically insulating material includes one of silicon oxide and silicon nitride deposited as a thin film on said semiconductor bridge, and said layer has a thickness between about 0.5 and 10 micrometers.

9. The detonator according to claim 8, wherein a mean grain size of the pyrotechnic substance is approximately equal to at least one dimension of the semiconductor bridge.

10. The detonator according to claim 1, wherein each of said at least two electrodes penetrates said metal endplate.

11. A method for manufacturing a pyrotechnic detonator comprising:

placing a pyrotechnic substance in a casing, said casing having a metal wall attached to a metal endplate;

penetrating the metal endplate by inserting at least one of at least two electrodes at least partially into said casing;

insulating at least one of said at least two electrodes from the metal endplate by an insulating material; and molding a plastics material around at least the metal endplate and a portion of the at least two electrodes.

12. The method according to claim 11, further comprising charging the casing by a wet loading process.

13. The method according to claim 11, wherein the penetrating step includes penetrating the metal endplate with each of said at least two electrodes.

14. The method according to claim 11, wherein the placing step occurs after the penetrating, insulating and molding steps.

15. A method for manufacturing a pyrotechnic detonator comprising:

placing a pyrotechnic substance in a casing, said casing having a metal wall attached to a metal endplate;

penetrating the metal endplate by at least one of at least two electrodes;

insulating at least one of said at least two electrodes from the metal endplate by an insulating material; and molding a plastics material around at least the metal endplate and a portion of the at least two electrodes, wherein the placing step takes place after the penetrating, insulating and molding steps.

* * * * *